US006267583B1

(12) United States Patent
Mandai et al.

(10) Patent No.: US 6,267,583 B1
(45) Date of Patent: Jul. 31, 2001

(54) COMBUSTOR

(75) Inventors: Shigemi Mandai; Koichi Nishida; Masataka Ota; Eiji Akita, all of Takasago (JP)

(73) Assignee: Mistubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/289,606

(22) Filed: Apr. 12, 1999

(30) Foreign Application Priority Data

| | | |
|---|---|---|
| Apr. 15, 1998 | (JP) | 10-104645 |
| Jul. 21, 1998 | (JP) | 10-205289 |
| Aug. 17, 1998 | (JP) | 10-230649 |

(51) Int. Cl.[7] ..... F23D 14/84
(52) U.S. Cl. ..... 431/285; 431/9; 431/278
(58) Field of Search ..... 431/8, 9, 10, 114, 431/181, 187, 183, 278, 284, 285, 116

(56) References Cited

U.S. PATENT DOCUMENTS

| | | | | |
|---|---|---|---|---|
| 3,115,851 | * | 12/1963 | Ceely . | |
| 3,834,858 | * | 9/1974 | Krippene et al. | 431/279 |
| 4,356,698 | | 11/1982 | Chamberlain . | |
| 5,373,694 | | 12/1994 | Clark . | |
| 5,387,100 | * | 2/1995 | Kobayashi | 431/8 |
| 5,415,114 | | 5/1995 | Monro et al. . | |
| 5,486,108 | * | 1/1996 | Kubota | 431/181 |
| 5,860,803 | * | 1/1999 | Schindler et al. | 431/9 |

FOREIGN PATENT DOCUMENTS

| | | | | |
|---|---|---|---|---|
| 196 15 910 | | 10/1997 | (DE) . | |
| 0 691 511 | | 1/1996 | (EP) . | |
| 035308 | * | 2/1983 | (JP) . | |
| 0035308 | * | 3/1983 | (JP) | 431/114 |
| 7-85388 | * | 1/1996 | (JP) . | |
| 8-285240 | | 11/1996 | (JP) . | |
| 98/12478 | | 3/1998 | (WO) . | |

OTHER PUBLICATIONS

Patent Abstracts of Japan No. 58 035308 dated Mar. 2, 1983.

Patent Abstracts of Japan 59 077206 dated May 2, 1984.

* cited by examiner

*Primary Examiner*—Carl D. Price
(74) *Attorney, Agent, or Firm*—Wenderoth, Lind & Ponack, L.L.P.

(57) ABSTRACT

A combustor includes a pilot fuel nozzle and a plurality of main premixing nozzles arranged therearound for forming a premixture of air and fuel supplied from a main fuel nozzle, and is improved so as not to cause vibratory combustion. Pilot fuel nozzle unit 104 comprises a plurality of pilot fuel nozzles 103. A plurality of main premixing nozzles 102 are disposed on a coaxial circumference of the pilot fuel nozzle unit 104. The pilot fuel nozzles 103 are arranged irregularly in a circumferential direction of the pilot fuel nozzle unit 104, so as to form portion 105 where there is no pilot fuel nozzle 103. Premature in the main premixing nozzles 102 positioned corresponding to the pilot fuel nozzle 103 burns with comparatively short flames. Premature in the main premixing nozzles 102 positioned corresponding to the portion 105 of no pilot fuel nozzle 103 burns with long flames because of flames spreading from adjacent main fuel nozzles. Thus, by differences in flame length, heat generation rate distribution is dispersed.

7 Claims, 12 Drawing Sheets

COMBUSTOR

BACKGROUND OF THE INVENTION

1. Field of the Invention

The present invention relates generally to a combustor and more specifically to a combustor which is appropriate for use as a gas turbine combustor.

2. Description of the Prior Art

One example of a premixed flame type combustor which is used as a prior art gas turbine low NOx type combustor is shown in FIG. 13, wherein FIG. 13(*a*) is a longitudinal cross sectional view of the combustor and FIG. 13(*b*) is a cross sectional view taken on line C—C of FIG. 13(*a*).

In FIG. 13, within a combustor 201 which is provided for a gas turbine cylinder, there are provided a plurality (eight pieces in this case) of main burners 202 around a central axis of the combustor 201. Each of the main burners 202 comprises therein a main fuel nozzle 203 of the same shape for all the main burners 202, and a main swirler 204 of also the same shape. Also, provided in a portion surrounded by the plurality of main burners 202 and along the central axis of the combustor 201 is a pilot burner 207, which comprises therein a pilot fuel nozzle 206 and a pilot swirler 205 provided around the pilot fuel nozzle 206.

Combustion air flowing inside of an outer periphery of the combustor 201 turns at an angle of 180° at an air inflow portion 208 to flow in the combustor 201 passing through the main swirler 204 of each of the main burners 202 and the pilot swirler 205 of the pilot burner 207.

In the pilot burner 205, pilot fuel supplied from the pilot fuel nozzle 206 is burned by the combustion air which has passed through the pilot swirler 205. In the main burner 202, main fuel supplied from the main fuel nozzle 203 and the combustion air which has passed through the main swirler 204 are mixed to form a premixture, which is fired by a pilot flame of the pilot fuel so that a low NOx combustion is effected in the combustor 201.

The premixture formed in the main burner 202 is fired by the pilot flame of the pilot fuel, as mentioned above. In this case, as there is substantially a regularity in a mixing state of the premixture between each of the plurality of main burners 202, the combustion state in each of the main burners 202 becomes regular. This results in a regularity in heat generation distribution throughout the combustor 201 along the central axis direction thereof, and there occurs a constant area where a large heat generation in the combustor 201 is concentrated.

For this reason, vibratory combustion is prone to occur due to such concentrated heat generation to cause a non-stability of the combustion, which results in a problem in that a low NOx combustion is hampered.

FIG. 14 is a cross sectional view showing one example of a prior art pilot nozzle of gas turbine. In FIG. 14, numeral 301 designates a nozzle body and numeral 302 designates an air passage in a peripheral portion of the nozzle body 301, into which air 311 is taken. Numeral 303 designates an oil fuel supply pipe which is provided in a central portion of the nozzle body 301 for leading therethrough an oil fuel 310. Numeral 304 designates a gas fuel passage for leading therethrough a gas fuel 312 when such is used. Numeral 305 designates an oil fuel injection port, numeral 306 designates an air injection port and numeral 307 designates a gas fuel injection port. In the nozzle so constructed, both the oil fuel 310 and the gas fuel 312 are usable wherein the fuel is injected from a tip end of the nozzle and the air 311 for diffusion and water 309 for cooling are injected as described later so that combustion is effected.

FIG. 15 is an enlarged cross sectional view of a tip end portion of the pilot nozzle of FIG. 14. In FIG. 15, when an oil fuel is used, the oil fuel 310 is supplied through the oil fuel supply pipe 303 to be injected for combustion into a combustion chamber from the oil fuel injection port 305 of the central portion. On the other hand, the air 311 flows through the air passage 302 in the peripheral portion of the nozzle body 301 to be injected from the air injection port 306 for diffusion of the fuel. Also, the water 309 is injected from a water injection port 308 provided around the oil fuel injection port 305 to cool a peripheral portion of the oil fuel injection port 305.

In the above-mentioned pilot nozzle, the oil fuel 310 injected from the oil fuel injection port 305 spreads into the surrounding area, as shown in FIG. 15. On the other hand, the air 311 is injected from the air injection port 306 at such an angle as to cross the oil fuel 310 so spreading, thus there is formed therebetween a stagnation area 320 into which neither the air 311 nor the oil fuel 310 comes. But a mist 321 is formed by a portion of the oil fuel 310 scattering there, and this mist flows into this stagnation area 320 and sticks to the tip end of the nozzle to accumulate there as an unburnt carbon 322. This unburnt carbon 322 increases gradually so that the water injection port 308 may be plugged and the flow of the air 311 from the air injection port 306 may be obstructed. As a result, there arises a problem in that the cooling performance of the peripheral portion of the oil fuel injection port 305 is deteriorated or the combustion performance is badly affected.

In case the oil fuel is used in the prior art gas turbine pilot nozzle, as mentioned above, the stagnation area 320 is formed between the oil fuel injection port 305 and the air injection port 306 and the mist 321 of the oil fuel 310 scatters and sticks to the tip end of the nozzle to accumulate while being carbonized as the unburnt carbon 322. This results in plugging of the water injection port 308 to obstruct the injection of the water which causes a problem affecting the nozzle performance such that the cooling performance of the peripheral portion of the oil fuel injection port 305 is deteriorated or the flow of the injected air is obstructed.

SUMMARY OF THE INVENTION

It is therefore an object of the present invention to provide a combustor which is able to dissolve shortcomings in the prior art combustor as shown in FIG. 13, in which a vibratory combustion due to a concentrated heat generation easily occurs resulting in an unstable combustion.

It is also an object of the present invention to provide a low NOx combustor in which there is formed a heat generation distribution that is averaged more in an axial direction of the combustor so that a heat generation may be less concentrated on a constant area, a stable combustion may be attained with less vibratory combustion, and so that a low NOx combustion may not be hampered.

It is a further object of the present invention to, provide a combustor which is able to solve shortcomings in the prior art combustor as shown in FIGS. 14, 15 in which an unburnt carbon sticking to and accumulating on a stagnation area is formed.

In order to attain the object of not causing a vibratory combustion, the present invention provides a combustor comprising a pilot fuel nozzle unit having therein a plurality of pilot fuel nozzles and a plurality of main premixing nozzle units disposed on a coaxial circumference surrounding the pilot fuel nozzle unit for mixing fuel supplied from a main fuel nozzle of the respective main premixing nozzle units with air to form a premixture. The plurality of pilot fuel nozzles are arranged irregularly in a circumferential direction of the pilot fuel nozzle unit.

In the combustor constructed so that the pilot fuel nozzles are arranged irregularly in a circumferential direction of the pilot fuel nozzle unit, the pilot fuel nozzles do not necessarily correspond to the main premixing nozzles one to one.

While the premixture coming from the main premixing nozzle which is positioned to correspond to the pilot fuel nozzle generates combustion with short flames, the premixture coming from the main premixing nozzle which is in a position where there is no corresponding pilot fuel nozzle generates combustion with long flames. Thus, in the combustor of the present invention so constructed, there are generated combustions of different flame lengths. Thus, the heat generation rate distribution is dispersed and there occurs no vibratory combustion.

Also, in order to attain the same object, the present invention provides a combustor constructed such that the premixture supplied from some of the plurality of main premixing nozzle units is made leaner than that supplied from the remaining main premixing nozzle units.

In the combustor of the present invention so constructed, combustion speed in the main premixing nozzle in which the premixture is made leaner is slow to form long flames, and combustion speed in the main premixing nozzle in which the premixture is not made leaner is fast to form comparatively short flames.

Thus, in the combustor of the present invention, the premixture supplied from some of the plurality of main premixing nozzles is made leaner than that supplied from the remainder. Thus, the heat generation rate can be dispersed so that a vibratory combustion can be avoided.

Also, in order to attain the object of obtaining a low NOx combustor, the present invention provides a combustor comprising a pilot burner provided on a central axis of the combustor and a plurality of main burners provided around the pilot burner. Each of the main burners has a main fuel nozzle disposed on a central axis of each of the main burners. A main swirler is disposed around the main fuel nozzle. Two or more types of main burners having different numbers of fuel injection ports of the main fuel nozzle are arranged in a circumferential direction of the combustor so that two of the same types may not adjoin each other.

According to the combustor of the present invention, two or more types of main burners having different numbers of fuel injection ports of the main fuel nozzle are provided in the combustor on a circumference surrounding the pilot burner so that two of the same types may not be adjoining each other. Therefore, the premixture does not become a constant state all around in the combustor, the portion where the heat generation rate is high is dispersed in the central axis direction of the combustor, a vibratory combustion caused by the concentrated heat generation is avoided, and a stable combustion is attained. Hence a low NOx combustor in which a low NOx combustion is not hampered can be obtained.

Also, in order to attain the same object, the present invention provides a combustor comprising a pilot burner provided on a central axis of the combustor and a plurality of main burners provided around the pilot burner. Each of the main burners has therein a main fuel nozzle disposed on a central axis of each of said main burners. A main swirler is disposed around said main fuel nozzle. Two or more types of main burners having different fitting angles of swirler vanes relative to a central axis direction of the main swirler are arranged in a circumferential direction of the combustor so that two of the same types may not adjoin each other.

According to the combustor of the present invention, two or more types of main burners having different fitting angles of swirler vanes relative to the main swirler central axis direction are provided in the combustor on a circumference surrounding the pilot burner so that two of the same types may not adjoin each other. As a result, the premixture does not become a constant state all around in the combustor, and the portion where the heat generation rate is high is dispersed so as to be averaged in the central axis direction of the combustor. Hence, a vibratory combustion caused by the concentrated heat generation is avoided, a stable combustion is attained, and a low NOx combustor in which a low NOx combustion is not hampered can be obtained.

Also, in order to attain the same object, the present invention provides a combustor comprising a pilot burner provided on a central axis of the combustor and a plurality of main burners provided around the pilot burner. Each of the main burners has therein a main fuel nozzle disposed on a central axis of each of the main burner, and a main swirler is disposed around the main fuel nozzle. A plurality of types of main burners in which two or more types of main burners having different numbers of fuel injection ports of main fuel nozzle and two or more types of main burners having different fitting angles of swirler vanes relative to a central axis direction of main swirler are combined are provided in a circumferential direction of the combustor so that two of the same types do not adjoin each other.

According to the combustor of the present invention, the heat generation rate distribution is further dispersed to be averaged so that a vibratory combustion due to the concentrated heat generation is avoided and a stable combustion is attained. Hence, a low NOx combustor in which a low Nox combustion is not hampered can be obtained.

Next, in order to attain the object mentioned above to provide a combustor which is able to solve the shortcomings in the prior art that unburnt carbon sticks to and accumulates on the nozzle tip end, the present invention provides a combustor comprising a fuel injection nozzle. The fuel injection nozzle has therein an oil fuel supply pipe provided in a nozzle central portion. An oil fuel injection port is provided at a nozzle tip end for injecting oil fuel supplied from the oil fuel supply pipe. An air passage is provided around the oil fuel supply pipe, and an air injection port is provided around the oil fuel injection port of the nozzle tip end for injecting air supplied from the air passage. The nozzle tip end has a cover ring which covers an outlet portion of the air injection port from outside of the nozzle tip end and has an opening at a central portion of itself.

According to the combustor of the present invention, the cover ring is provided at the nozzle tip end and the cover ring covers the air outlet portion of the air injection port of the periphery of the nozzle tip end in a ring shape from outside of the nozzle tip end and has the opening in its central portion so that oil fuel injection from the oil fuel injection port can be done sufficiently. Thereby, by the effect of the cover ring, the air injected flows toward the nozzle central axis direction, and even if the mist of the oil fuel scatters and wants to stick, it is blown so as to be prevented from sticking. In the prior art case, there has been formed a stagnation area between the air injection port and the oil fuel injection port where the mist of the oil fuel scatters and sticks to the nozzle tip end. This sticking mist is carbonized so as to accumulate as an unburnt carbon which results in shortcomings in that the water injection port around the oil fuel injection port is plugged, etc. In the combustor of the present invention, however, the mist is prevented from sticking. Hence, there is caused no accumulation of the unburnt carbon.

DESCRIPTION OF THE PREFERRED EMBODIMENTS

First Embodiment

Figure 1A:
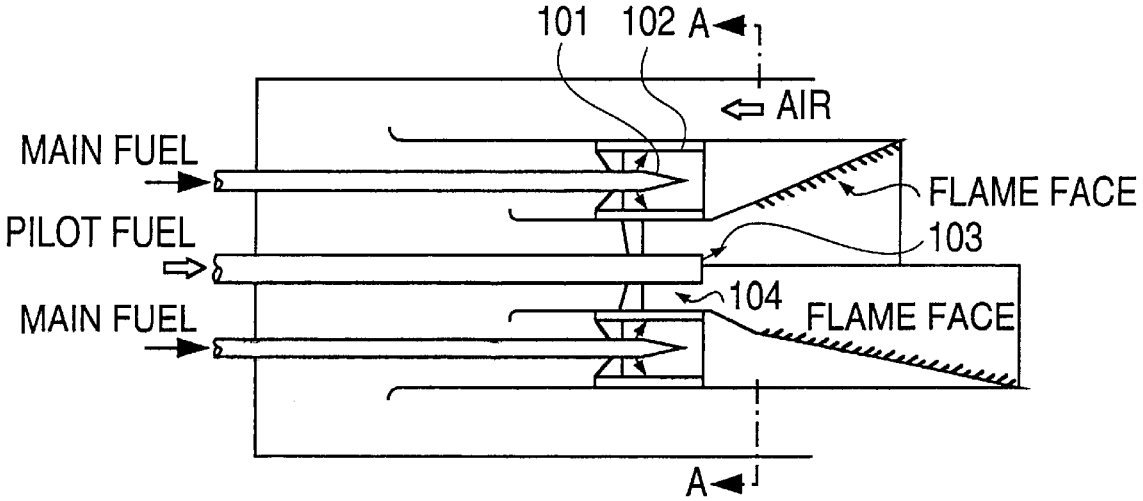
FIG. 1 is a view showing a combustor of a first embodiment according to the present invention, wherein FIG. 1(*a*) is a longitudinal cross sectional view and FIG. 1(*b*) is a half cross sectional view taken on line A—A of FIG. 1(*a*).
Figure 1B:
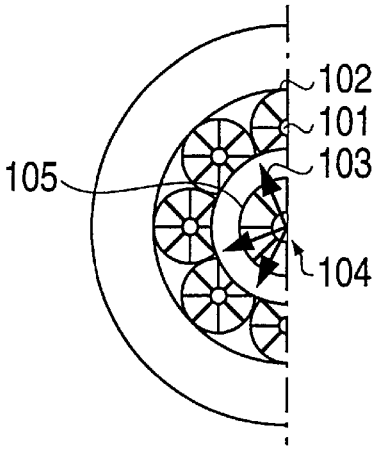

A combustor of a first embodiment according to the present invention will be described with reference to FIG. 1. In FIG. 1, numeral 104 designates a pilot fuel nozzle unit. Around the pilot fuel nozzle unit 104 and on a coaxial circumference thereof, there are provided a plurality of main premixing nozzle units 102, each comprising therein a main fuel nozzle 101 disposed in a central portion thereof Fuel supplied from the main fuel nozzle 101 is mixed with air to form a premixture.

On the other hand, in the pilot fuel nozzle unit 104, there are provided a plurality of pilot fuel nozzles 103, which are arranged irregularly in a circumferential direction so that there is formed a portion 105. None of the pilot fuel nozzles 103 are provided in portion 105 so that the main premixing nozzle units disposed around the pilot fuel nozzle unit 104 may not be correspondingly provided to the pilot fuel nozzles 103.

This is a characteristic feature in the construction as compared with the prior art combustor where each of the main premixing nozzle units is arranged corresponding to each of the pilot fuel nozzles.

In the combustor of FIG. 1 constructed as above, the fuel supplied from the main fuel nozzles 101 is mixed with air in the respective main premixing nozzle units 102 to form the premixture. In this combustor, there is formed the portion 105 where none of the pilot fuel nozzles 103 are provided in the pilot fuel nozzle unit 104. Hence, in this portion 105, the premixture which has been injected from the respective main premixing nozzle units 102 burns with long flames. It is to be noted that the arrangement and number of the portion 105 where none of the pilot fuel nozzles 103 are provided may be decided arbitrarily.

On the contrary, the premixture which has been injected from the respective main premixing nozzle units 102 in the portion where the pilot fuel nozzles 103 are provided burns with comparatively short flames. The combustion state of such long flames and short flames is shown schematically in FIG. 1(*a*). Thus, such a combustion as having differences in the flame length takes place, thereby the heat generation rate distribution is dispersed and occurrence of vibratory combustion is prevented.

Second Embodiment

A combustor of a second embodiment according to the present invention will be described with reference to FIG. 2. In the combustor shown in FIG. 2, each of the pilot fuel nozzles 103 is provided corresponding to each of the main premixing nozzle units 102, and there is formed none of the portion 105 where none of the pilot fuel nozzles 103 is provided as in the combustor of the first embodiment.

In the combustor of the second embodiment, flow rate of the fuel supplied from a main fuel nozzle 106 is reduced to 60 to 90% of the flow rate of the fuel supplied from the other main fuel nozzle 101.

Thus, the premixture which is injected from the respective main premixing nozzle units 107 which include the main fuel nozzle 106 supplying the lower flow rate of the main fuel has a lean fuel concentration. In contrast, the premixture injected from the respective main premixing nozzle units 102 which include the main fuel nozzle 101 supply no lower flow rate of the main fuel.

It is to be noted that which of the plurality (eight pieces for example) of main premixing nozzle units is to be changed to the lean fuel, and in what degree of fuel leanness it is to be changed to may be decided arbitrarily.

Construction of other portions of the combustor of the second embodiment is the same as that of the combustor of the first embodiment with repeated description being omitted.

Figure 2A:
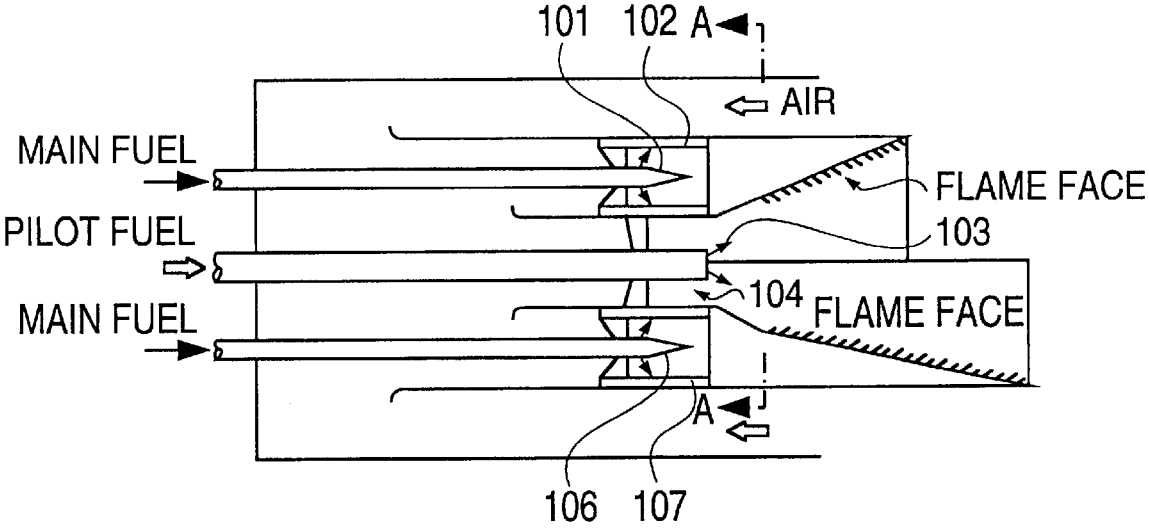
FIG. 2 is a view showing a combustor of a second embodiment according to the present invention, wherein FIG. 2(*a*) is a longitudinal cross sectional view and FIG. 2(*b*) is a half cross sectional view taken on line A—A of FIG. 2(*a*).
Figure 2B:
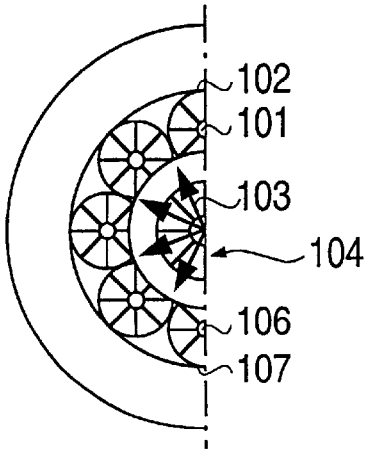

In the combustor of FIG. 2 constructed as above, the fuels supplied from the main fuel nozzles 101, 106 are mixed with air in the main premixing nozzle units 102, 107, respectively, to form a main premixture. This main premixture is burned by diffusion flames formed by fuel supplied from the respective pilot fuel nozzles 103.

In the above, the lower fuel flow rate supplied from the main fuel nozzle 106 is 60 to 90%, for example, of that supplied from the main fuel nozzle 101. In addition, the premixture supplied from the respective main premixing nozzle units (lean) 107 provided with the main fuel nozzle 106 is made leaner than that supplied from the respective main premixing nozzle units 102 provided with the main fuel nozzle 101.

As shown in FIG. 2(*a*), the premixture supplied from the respective main premixing nozzle units 102 having no such leaner fuel concentration burns with comparatively short flames, while the leaner premixture supplied from the respective main premixing nozzle units 107 having the leaner fuel concentration burns with long flames since the combustion speed is low.

Thus, according to the combustor of the second embodiment, the premixture supplied from some of the main premixing nozzle units is made leaner than that supplied from the remainder. As a result, the heat generation rate can be dispersed and occurrence of vibratory combustion can be avoided.

Third Embodiment

Figure 3A:
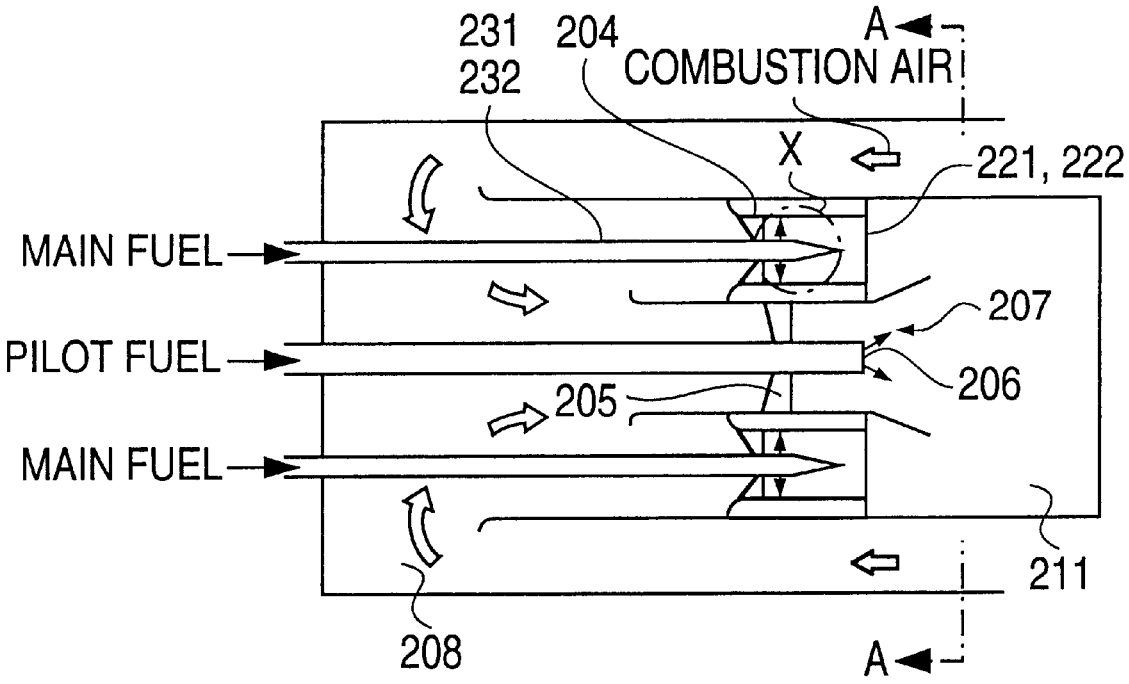
FIG. 3 is a view showing a low NOx combustor of a third embodiment according to the present invention, wherein FIG. 3(*a*) is a longitudinal cross sectional view and FIG. 3(*b*) is a half cross sectional view taken on line A—A of FIG. 3(*a*).
Figure 3B:
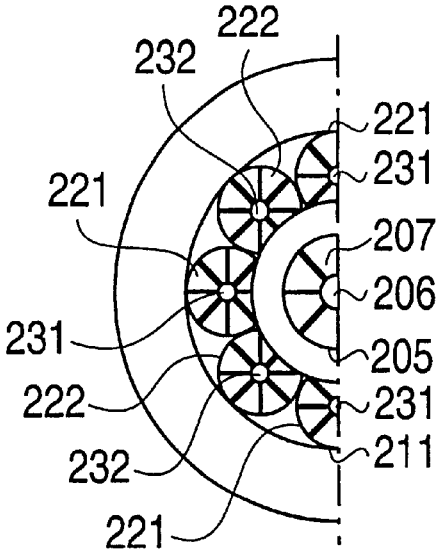
Figure 13A:
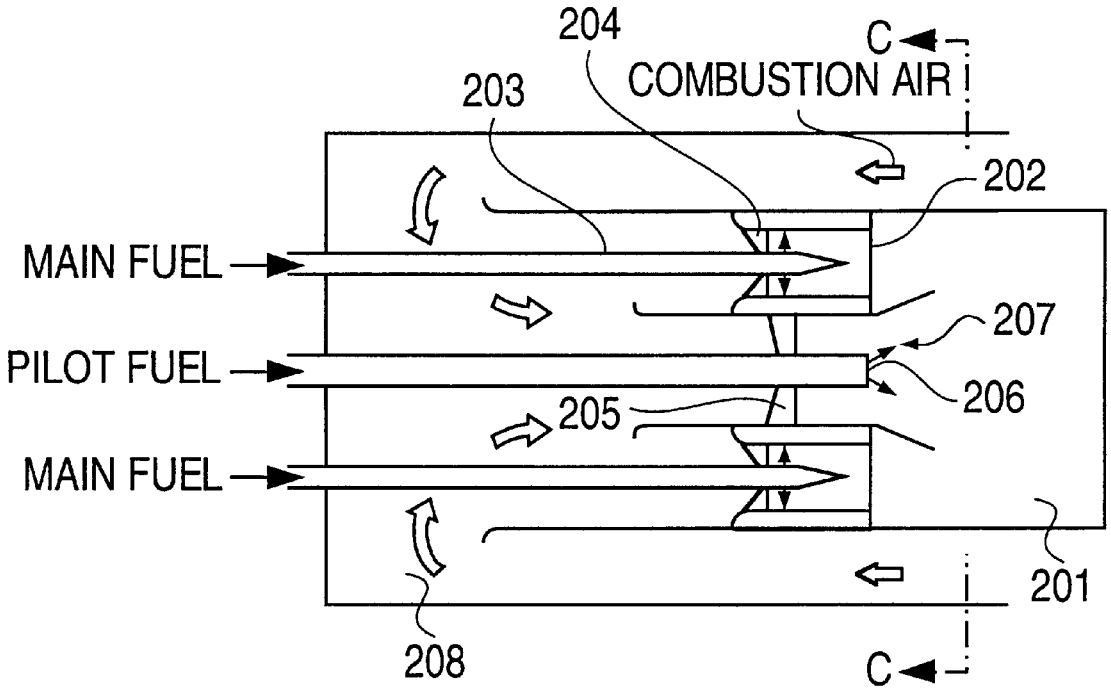
FIG. 13(a) (PRIOR ART)
FIG. 13 is a view showing an example of a low NOx combustor in the prior art, wherein FIG. 13(*a*) is a longitudinal cross sectional view and FIG. 13(*b*) is a half cross sectional view taken on line C—C of FIG. 13(*a*).
Figure 13B:
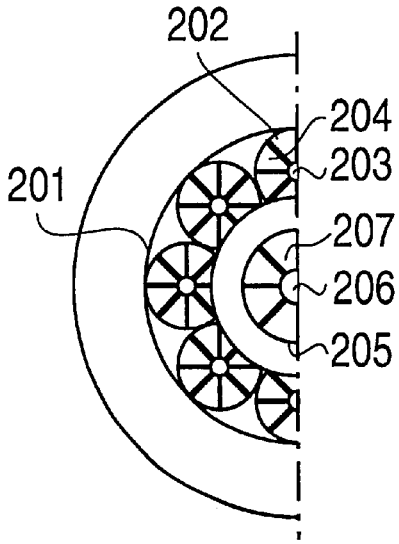
FIG. 13(b) (PRIOR ART)

Next, a combustor of a third embodiment according to the present invention will be described with reference to FIGS. 3 to 6. In FIG. 3, a main swirler 204, a pilot swirler 205, a pilot fuel nozzle 206, a pilot burner 207 and an air inflow portion 208 are the same as those of the prior art described in FIG. 13. But in a combustor 201 of the present embodiment, in place of the main fuel nozzle 203 having the same common shape as shown in FIG. 13, there are provided two groups of main burners 221, 222 comprising therein two types of main fuel nozzles 231, 232, respectively, having mutually different shapes.

Figure 4A:
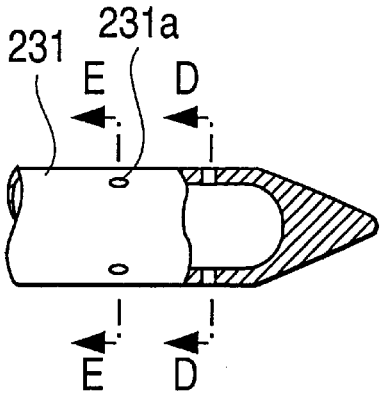
FIG. 4 is an enlarged view of a nozzle of X-portion of FIG. 3(*a*), wherein FIG. 4(*a*) is a longitudinal, partly cut away, view of an N1 type nozzle, FIG. 4(*a*1) is a cross sectional view taken on line D—D of FIG. 4(*a*), FIG. 4(*a*2) is a cross sectional view taken on line E-E of FIG. 4(*a*), FIG. 4(*b*) is a longitudinal, partly cut away, cross sectional view of an N2 type nozzle and FIG. 4(*b*1) is a cross sectional view taken on line F—F of FIG. 4(*b*).
Figure 4:
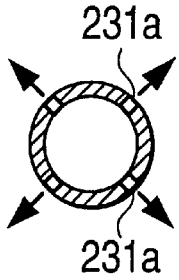
Figure 4:
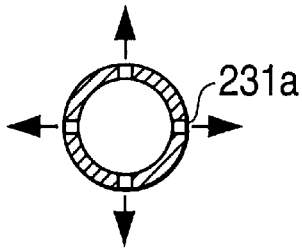
Figure 4B:
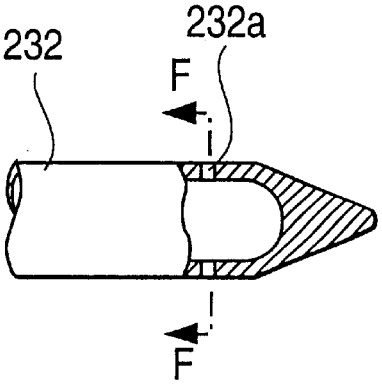
Figure 4:
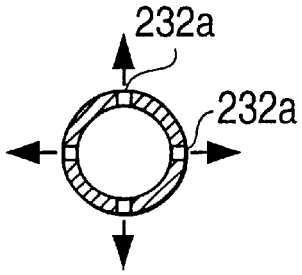
Figure 5A:
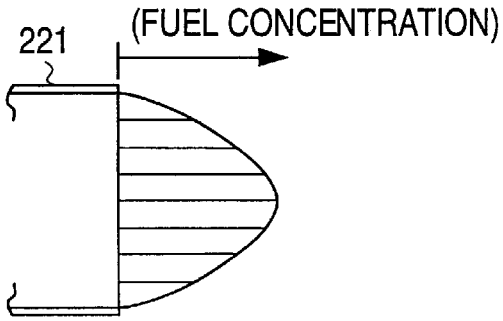
FIG. 5 is an explanatory view of fuel concentration distribution in the combustor of the third embodiment, wherein FIG. 5(*a*) shows the distribution at a main burner 221 outlet and FIG. 5(*b*) shows the distribution at a main burner 222 outlet.
Figure 5B:
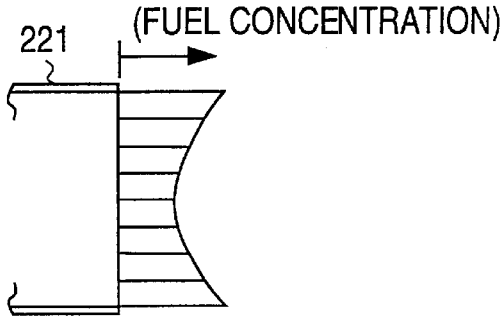

That is, the main burner 221 of one group thereof comprises an N1 type main fuel nozzle 231 as shown in FIG. 4(*a*) and the main burner 222 of the other group comprises an N2 type main fuel nozzle 232 as shown in FIG. 4(*b*). These two groups of main burners 221, 222 are arranged alternately on a circumference surrounding the pilot burner 207 in the combustor 211 as shown in FIG. 3(*b*). The main swirler 204 is of a same shape for both the main burners 221, 222.

As shown in FIG. 4(*a*), the N1 type main fuel nozzle 231 in the first group of main burners has two sectional planes of positions where fuel injection ports 231*a* are provided. One of the planes taken on line D—D of FIG. 4(*a*) is shown in FIG. 4(*a*1) and the other taken on line E—E of FIG. 4(*a*) is shown in FIG. 4(*a*2). As seen there, there are four fuel injection ports 231*a* in each of the planes, and directions of the fuel injection ports 231*a* alternate mutually between the two planes.

On the other hand, as shown in FIG. 4(*b*), the N2 type main fuel nozzle 232 in the second group of main burners has one sectional plane of position where fuel injection ports 232*a* are provided. The plane taken on line F—F of FIG. 4(*b*) is shown in FIG. 4(*b*1). As shown, there are provided four fuel injection ports 232*a* in the plane.

Accordingly, the number of fuel injection ports 231 a of the N1 type main fuel nozzle 231 is double that of the fuel injection ports 232*a* of the N2 type main fuel nozzle 232. However, a total injection port area of the fuel injection ports 231*a* of the N1 type main fuel nozzle 231 is made equal to that of the fuel injection ports 232*a* of the N2 type main fuel nozzle 232, thereby the construction is made such that the fuel flow rate from each type of the main fuel nozzles becomes equal.

In the mentioned third embodiment, each of the first group of main burners 221 comprises the N1 type main fuel nozzle which has many fuel injection ports 231*a*. Thus, fuel injection rate per fuel injection port 231*a* is small, so that the penetrating force of the fuel is lowered. Hence, the premixture there is so formed that the fuel concentration becomes high in a central portion of the outlet of the main burner 221 and low in outer peripheral portions of same, as shown by fuel concentration distribution of FIG. 5(*a*).

On the other hand, each of the second group of main burners 222 comprises the N2 type main fuel nozzle 232 which has a smaller number of fuel injection ports 232*a*. Thus, fuel injection rate per fuel injection port 232*a* is large, so that the penetrating force of the fuel becomes high as compared with the fuel injection port 231*a*. Hence, the premixture there is formed so that the fuel concentration becomes high in outer peripheral portions of the outlet of the main burner 222 reversely, as shown by the fuel concentration distribution of FIG. 5(*b*).

The premixture which has come out of the main burner is fired by peripheral pilot flames as a heat source. If the fuel concentration is low in the outer peripheral portions of the burner outlet, like in the main burner 221, the combustion speed is slow and flames become longer. Then if the flames spread to the central portion of the premixture, as the fuel concentration there is high, a strong heat generation occurs suddenly in the area comparatively apart from the outlet of the main burner 221. On the other hand, if the fuel concentration is high in the outer peripheral portions of the burner outlet, like in the main burner 222, the combustion speed becomes higher, flames become shorter, and a strong heat generation occurs in the area comparatively near the outlet of the main burner 222.

In any case, if the main burners comprising the main fuel nozzles of the same type would be arranged on an entire circumference of the combustor 211, like in the prior art case, it is so considered that there would be a concentrated high heat generation in a constant area of the combustor and there would occur the mentioned vibratory combustion due to this concentrated heat generation.

Figure 6:
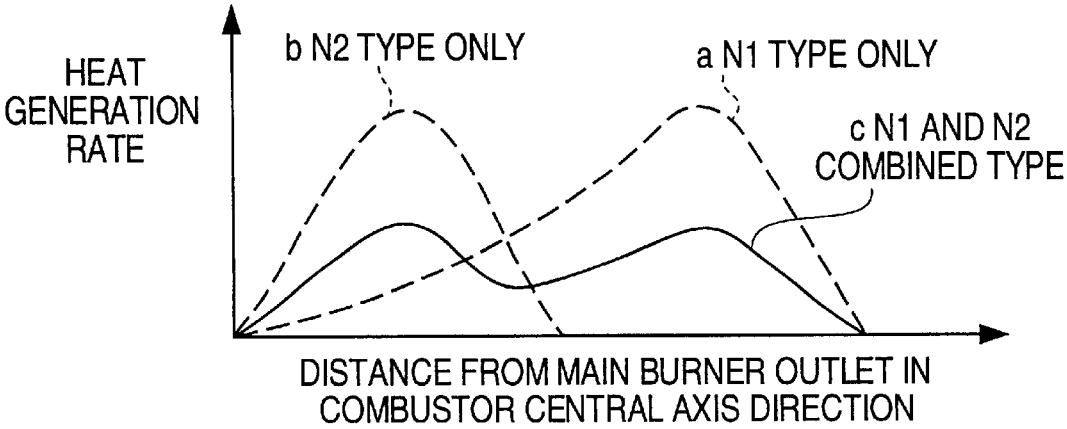
FIG. 6 is a conceptual view of heat generation rate in the combustor of the third embodiment.

FIG. 6 is a conceptual view showing the distribution of heat generation rate in the combustors corresponding to the types of main burners mentioned above. The vertical axis shows heat generation rate and the horizontal axis shows distance from the main burner outlet in the combustor central axis direction.

In FIG. 6, broken line a shows the heat generation rate of a combustor in which only the main burners 221, each having therein the N1 type main fuel nozzle 231, are provided, and broken line b shows the heat generation rate of a combustor in which only the main burners 222, each having therein the N2 type main fuel nozzle 232, are provided. Both of these combustors correspond to the mentioned combustor 201 in the prior art, and there occurs the concentrated heat generation in the area of a constant distance in the combustor central axis direction resulting in the problem of vibratory combustion.

In the present third embodiment, as mentioned above, the main burner 221 comprising the N1 type main fuel nozzle 231 and the main burner 222 comprising the N2 type main fuel nozzle 232 are provided alternately on a circumference surrounding the pilot burner 207 in the combustor 211. The premixture is prevented from becoming a regular state all around in the combustor 211. Thereby, as shown by solid line c in FIG. 6, there are formed mixedly an area where the combustion speed is fast in the combustor central axis direction and an area where it is slow in the same direction and the portion where the heat generation rate is high is dispersed. Thus, a vibratory combustion caused by the concentrated heat generation is avoided, and a stable combustion is attained. As a result, a low NOx combustor in which a low NOx combustion is not hampered can be obtained.

It is to be noted that although the main fuel nozzle has been described with respect to two types of N1 type main fuel nozzle 231 and the N2 type main fuel nozzle 232 in the present third embodiment, it is not necessarily limited to these two types. Also, the number, arrangement and direction of the fuel injection ports of the respective main fuel nozzles are not limited to those shown in FIG. 1 or 2 but may be decided arbitrarily.

That is, the main burner maybe made in plural types wherein the main fuel nozzle has different numbers of fuel injection ports. Also, the number of main burners is not limited to eight in total as illustrated but two or more types of main burners may be arranged on a circumference surrounding the pilot burner 207 in the combustor 211 so that a same type may not be adjoined each other. In this regard what is most important is to avoid the concentrated heat generation.

Fourth Embodiment

Figure 7A:
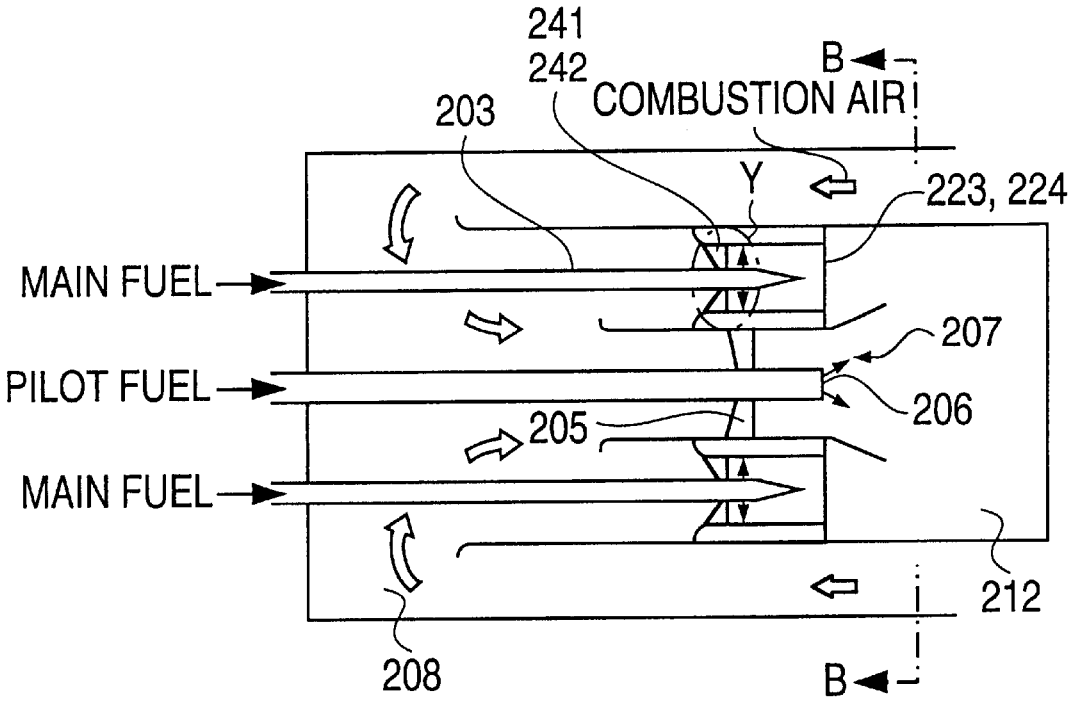
FIG. 7 is a view showing a low NOx combustor of a fourth embodiment according to the present invention, wherein FIG. 7(*a*) is a longitudinal cross sectional view and FIG. 7(*b*) is a half cross sectional view taken on line B—B of FIG. 7(*a*).
Figure 7B:
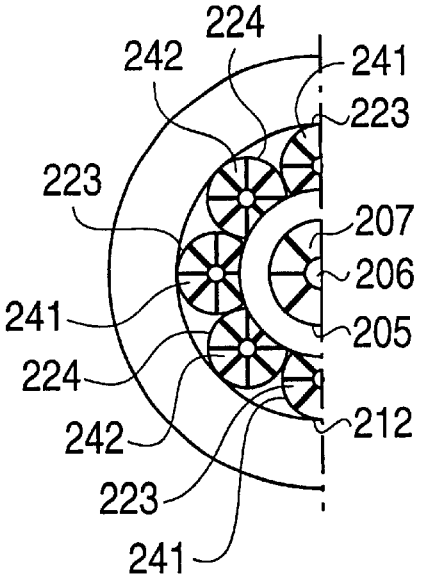

A combustor of a fourth embodiment will be described with reference to FIG. 7. In FIG. 7, a main fuel nozzle 203, a pilot swirler 205, a pilot fuel nozzle 206, a pilot burner 207 and an air inflow portion 208 are the same as those of the prior art described in FIG. 13. But in a combustor 212 of the present embodiment, in place of the main swirler 204 having the same common shape as shown in FIG. 13, there are provided two groups of main burners 223, 224 (a third group and a fourth group) comprising therein two types of main swirlers 241, 242, respectively, having mutually different shapes.

Figure 8A:
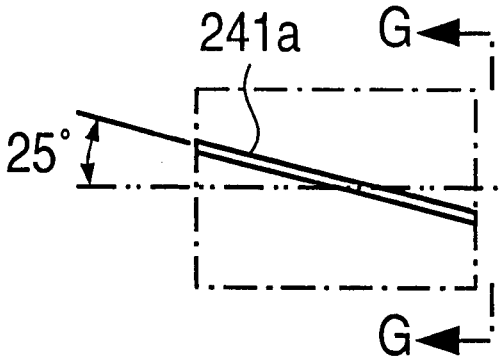
FIG. 8 is an enlarged view of a main swirler of Y-portion of FIG. 7(*a*), wherein FIG. 8(*a*) is a view showing an S1 type main swirler, FIG. 8(*a*1) is a view seen from line G—G of FIG. 8(*a*), FIG. 8(*b*) is a view showing an S2 type main swirler and FIG. 8(*b*1) is a view seen from line H—H of FIG. 8(*b*).
Figure 8:
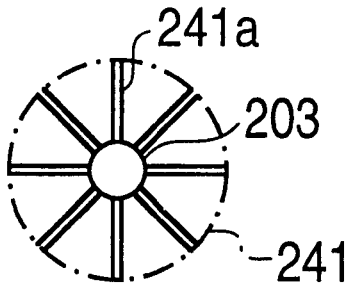
Figure 8B:
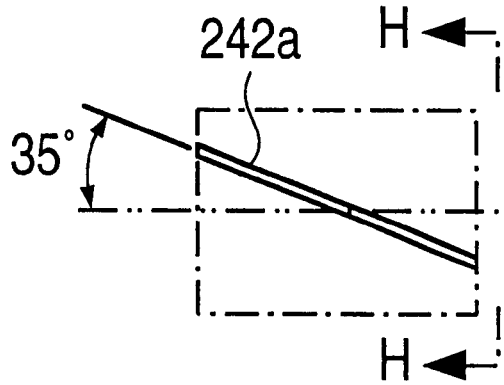
Figure 8:
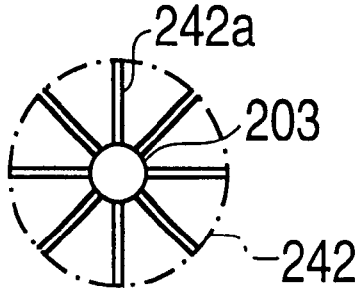

In the above, an S1 type main swirler 241 has its swirler vane 241a fitted at an incline with an angle of 25° to an axial direction of the SI type main swirler 241 as shown in FIG. 8(*a*), and an S2 type main swirler 242 has its swirler vane 242*a* fitted at an incline with an angle of 35° to an axial direction of the S2 type main swirler 242 as shown in FIG. 8(*b*).

That is, the main burner 223 of the third group comprises the S1 type main swirler 241 shown in FIG. 8(*a*) and the main burner 224 of the fourth group comprises the S2 type main swirler 242 shown in FIG. 8(*b*). These two groups of main burners 223, 224 are arranged alternately on a circumference surrounding the pilot burner 207 in the combustor 212 as shown in FIG. 7(*b*). The main fuel nozzle 203 is of the same shape both for the main burners 223, 224.

Figure 9A:
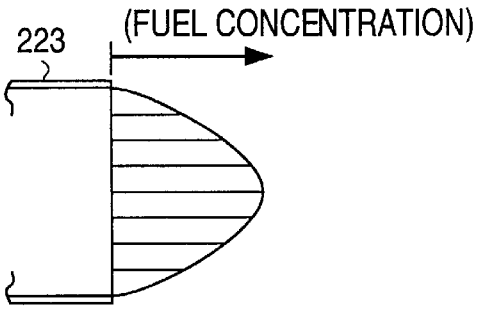
FIG. 9 is an explanatory view of fuel concentration distribution in the combustor of the fourth embodiment, wherein FIG. 9(*a*) shows the distribution at a main burner 223 outlet and FIG. 9(*b*) shows the distribution at a main burner 224 outlet.
Figure 9B:
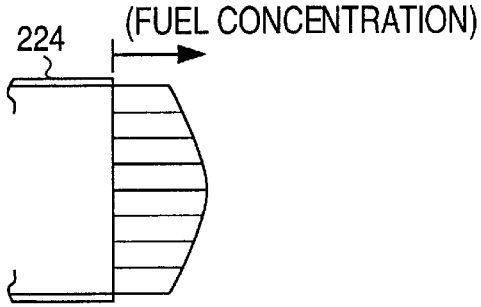

In the present fourth embodiment, the main burner 223 comprises the S1 type main swirler 241 wherein the fitting angle of the swirler vane 241*a* is made smaller. Thus, premixing of the fuel is in a comparatively irregular state and the premixture there is formed so that the fuel concentration becomes high in a central portion of the outlet of the main burner 223 and low in outer peripheral portions of same, as shown by fuel concentration distribution of FIG. 9(*a*).

On the other hand, the main burner 224 comprises the S2 type main swirler 242 wherein the fitting angle of the swirler vane 242*a* is made larger. Thus, premixing of the fuel is in a comparatively good and regular state, as shown by fuel concentration distribution of FIG. 9(*b*).

Figure 10:
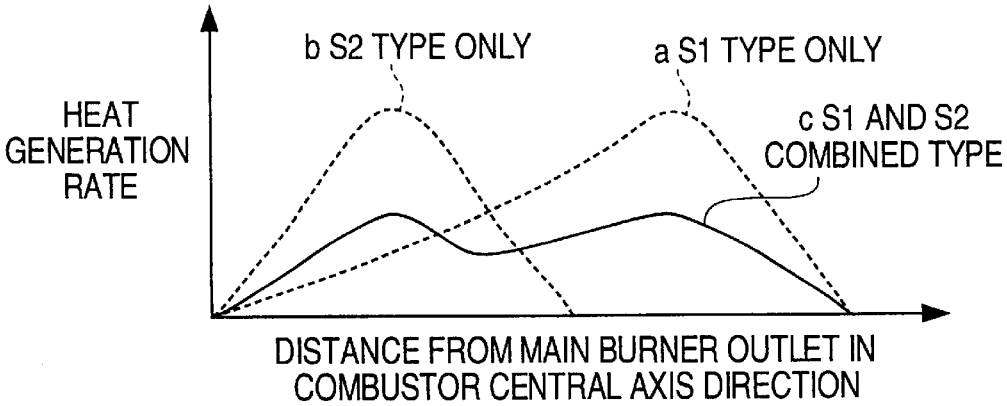
FIG. 10 is a conceptual view of a heat generation rate in the combustor of the fourth embodiment.

FIG. 10 is a conceptual view showing the distribution of heat generation rate in the combustors corresponding to the groups of main burners comprising the main swirlers mentioned above, wherein the vertical axis shows heat generation rate and the horizontal axis shows distance from the main burner outlet in the combustor central axis direction.

In FIG. 10, broken line a shows the heat generation rate of a combustor in which only the main burners 223, each having therein the S1 type main swirler 241, are provided. Broken line b shows the heat generation rate of a combustor in which only the main burners 224, each having therein the S2 type main swirler 242, are provided. Both of these combustors correspond to the mentioned combustor 201 in the prior art and there occurs the concentrated heat generation in the area of a constant distance in the combustor central axis direction resulting in the problem of vibratory combustion.

In the present fourth embodiment, as mentioned above, the main burner 223 comprising the S1 type main swirler 241 and the main burner 224 comprising the S2 type main swirler 241 are provided alternately on a circumference surrounding the pilot burner 207 in the combustor 212. The premixture is prevented from becoming a regular state all around in the combustor 212. Thereby, as shown by solid line c in FIG. 10, there are formed mixedly an area where the combustion speed is fast in the combustor central axis direction and an area where it is slow in the same direction, and the portion where the heat generation rate is high is dispersed. Thus, a vibratory combustion caused by the concentrated heat generation is avoided and a stable combustion is attained, so that a low NOx combustor in which a low NOx combustion is not hampered can be obtained.

It is to be noted that although the main swirler has been described with respect to the two types of the S1 type main swirler 241 and the S2 type main swirler 242 in the present embodiment, it is not necessarily limited to these two types. Also, the fitting angle, number, arrangement and direction of the swirler vane of the respective main swirlers are not limited to those shown in FIG. 7 or 8 but may be decided arbitrarily.

That is, the main swirler may be made in plural types wherein the swirler vane has different fitting angles of the vane to the main swirler central axis direction. Also, the number of main burners is not limited to eight in total as illustrated but two or more types of the main burners may be arranged on a circumference surrounding the pilot burner 207 in the combustor 212 so that the same type may not adjoin each other. What is important is to avoid the concentrated heat generation.

Fifth Embodiment

As a fifth embodiment, a combustor may be constructed such that a plurality of various types of main burner are arranged on a circumference surrounding a pilot burner so that the same type may not be adjoined. The main burner is made by a combination of the plural types of the main fuel nozzles as described in the third embodiment and the plural types of the main swirlers as described in the fourth embodiment. In other words, some or all of the main burners in the first and second groups described above in the third embodiment can be combined with some or all of the main burners in the third and fourth groups of main burners described above in the fourth embodiment.

According to the fifth embodiment, in addition to the effect of the third and fourth embodiments, the heat generation rate distribution in the combustor central axis direction is further dispersed to be averaged. Therefore, a vibratory combustion due to the concentrated heat generation is prevented, a stable combustion is attained, and a low NOx combustor in which a low NOx combustion is not hampered can be obtained.

Sixth Embodiment

Figure 15:
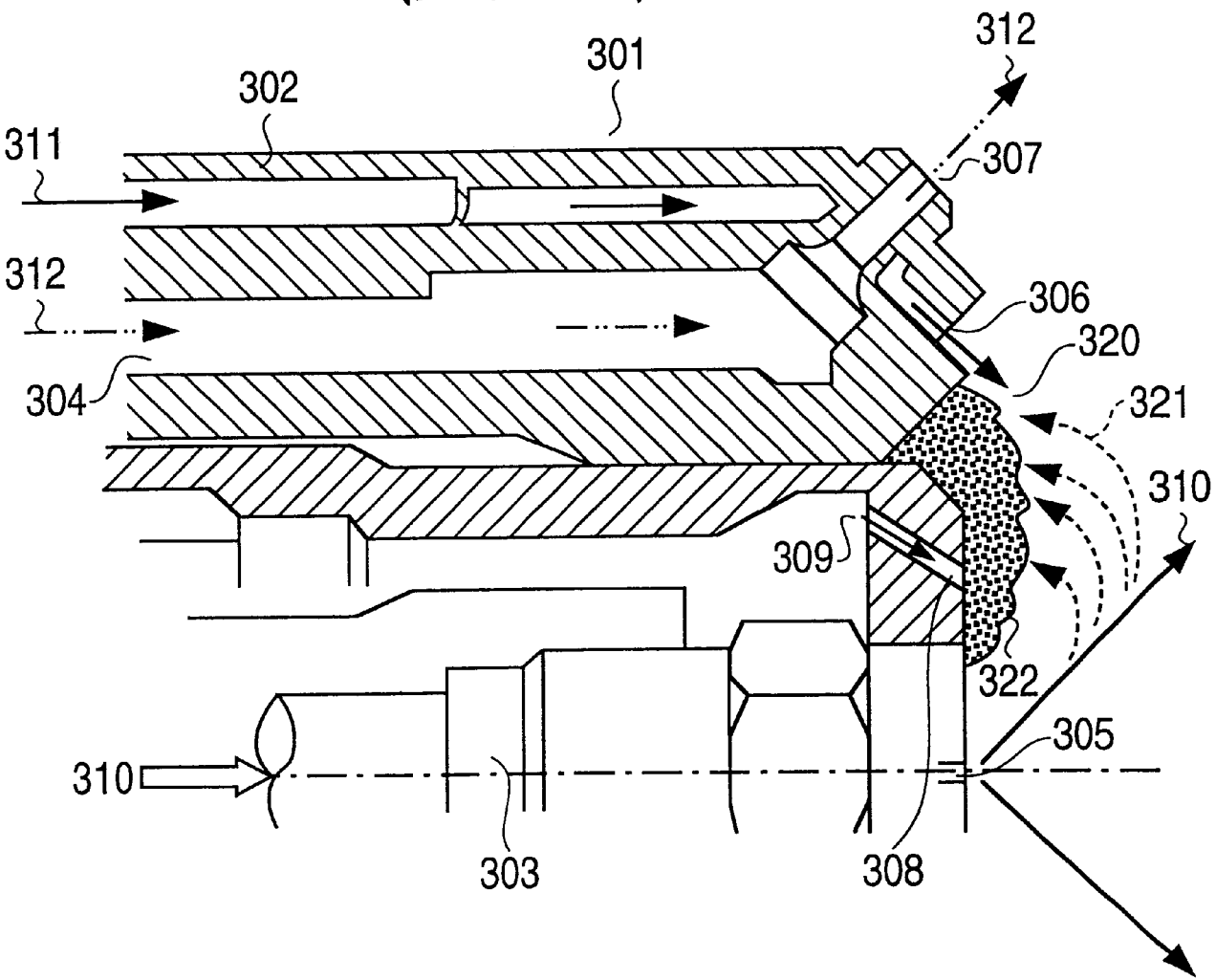
FIG. 15 (PRIOR ART)
FIG. 15 is an enlarged cross sectional view of a tip end portion of the pilot nozzle of FIG. 14.

Next, a combustor of a sixth embodiment according to the present invention will be described with reference to FIGS. 11 and 12. It is to be noted that portions of FIGS. 11 and 12 which are the same as those of the combustor in the prior art shown in FIG. 15 are given the same reference numerals and a description thereon will be omitted.

Figure 11:
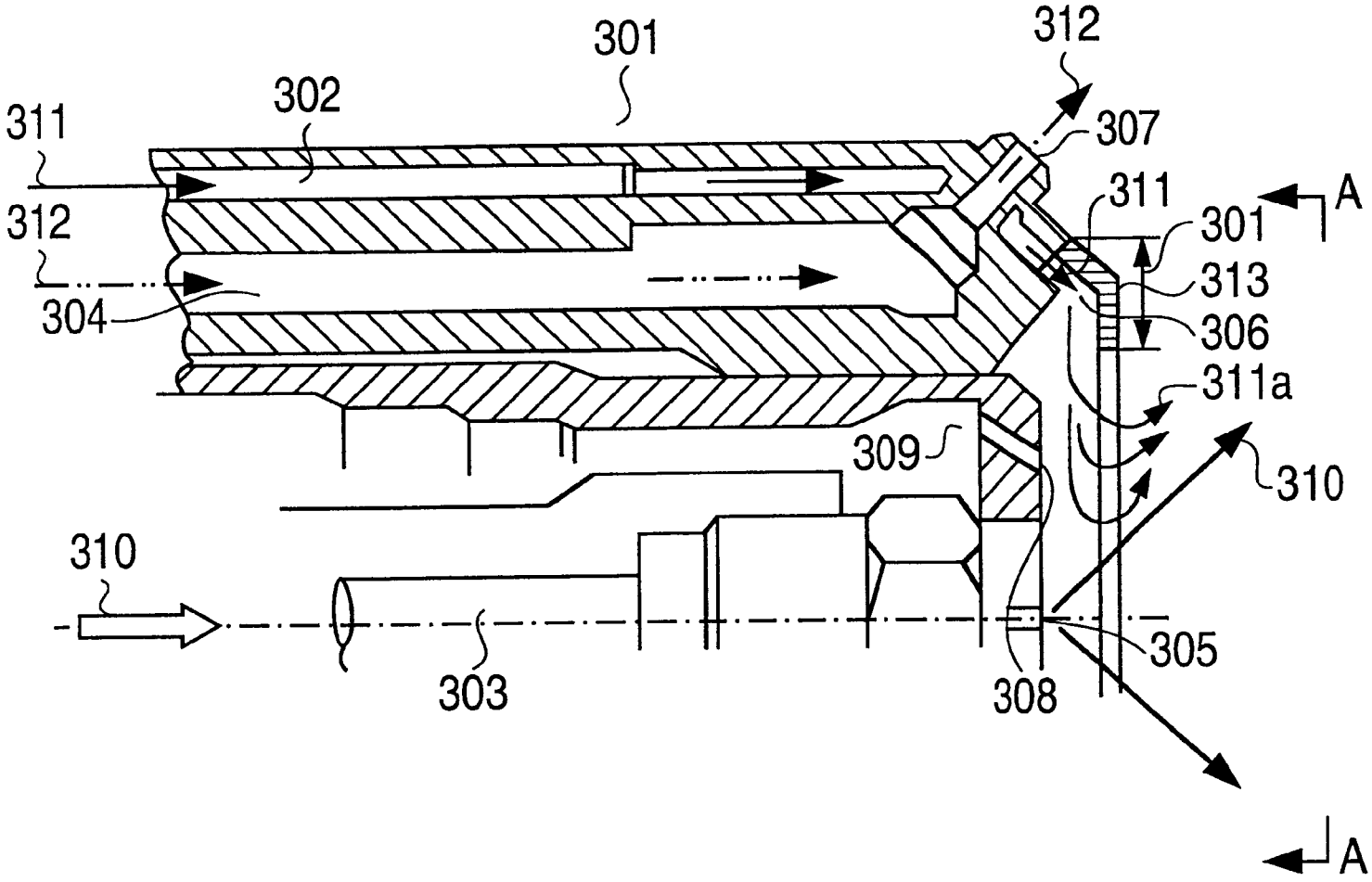
FIG. 11 is a cross sectional view of a nozzle tip end portion of a combustor of a sixth embodiment according to the present invention.

In FIG. 11, there is provided for a pilot nozzle end portion an annular type cover ring 313 which covers all around an entire circumferential portion of an outlet portion of an air injection port 306. A central portion of the cover ring 313 is open so that injection of the oil fuel 310 and of the air 311 in the central portion may not be obstructed. A peripheral portion of the cover ring 313 extends toward a direction to cross a nozzle central axis orthogonally, and its length L is set so as not to cover the water injection port 308.

In the construction mentioned above, the oil fuel 310 is injected from the oil fuel injection port 305, like in the prior art case. The air 311 for diffusion passes through the air passage 302 in a peripheral portion of the nozzle to be injected from the air injection port 306 of the nozzle end portion. But, as the cover ring 313 covers the outer side of outlet portion of the air injection port 306, the air 311 so injected does not flow straight but turns toward the direction to cross the nozzle central axis orthogonally, as shown by flow 311*a*, to join the oil fuel 310 to be used for combustion.

The air 311 flows in the direction so as to cross the nozzle central axis orthogonally as mentioned above. Thus, the mist 321 of the oil fuel scattering into the stagnation area 320 as has been so far formed in the prior art case is prevented from so scattering by the flow 311*a* of the air. As a result, the mist 321 does not stick to the nozzle end portion but is blown into the combustion area, so that there occurs no case of the mist 321 accumulating on the nozzle end portion as an unburnt carbon.

Figure 12:
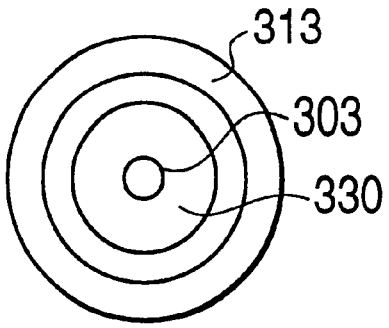
FIG. 12 is a view seen from line A—A of FIG. 11.
Figure 14:
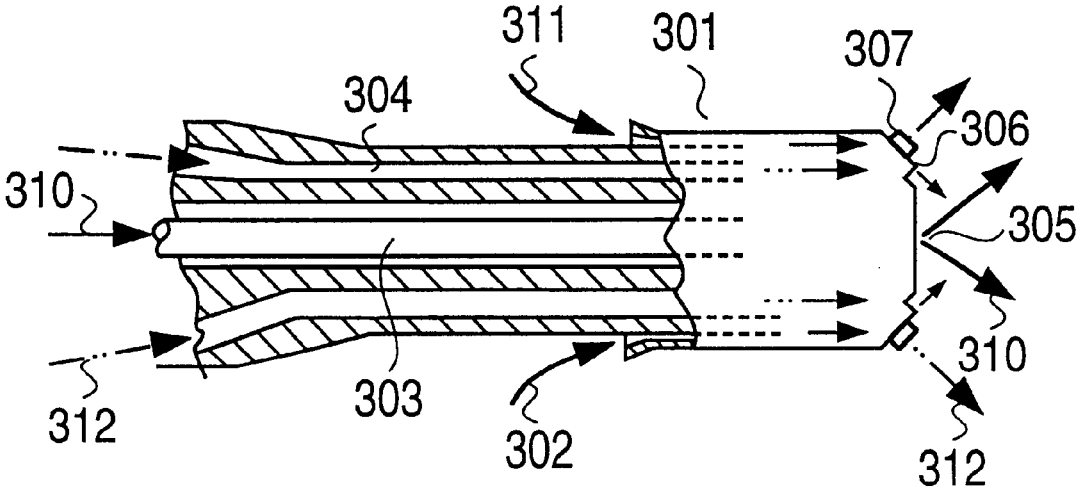
FIG. 14 (PRIOR ART)
FIG. 14 is a cross sectional view of a pilot nozzle in the prior art.

FIG. 12 is a view seen from line A—A of FIG. 11 to show an entire portion of the cover ring 313. As shown there, the cover ring 313 is made such that a front portion thereof has in its central portion an opening portion 330 of circle shape thereby not to obstruct the fuel injection from the oil fuel injection port 305. A ring peripheral portion thereof covers the whole portion around the nozzle end portion. By this cover ring 313, the stagnation area so far formed in the prior art case is covered, and the mist is prevented from scattering into this area by the air injected thereinto.

According to the present sixth embodiment, as described above, there is provided at the end portion of the nozzle body 301 the cover ring 313 so as to cover the air injection port 306 all around the nozzle end portion. Thus, the mist of the oil fuel scattering to the nozzle end portion is blown off by the air so as to be prevented from sticking to the nozzle end portion, and there occurs no case where the water injection port 308 is plugged so that reliability of the nozzle is enhanced.

What is claimed is:

1. A combustor apparatus comprising:

a pilot burner; and a plurality of main burners arranged around a periphery of said pilot burner, each of said main burners having a main fuel nozzle on a central axis of said each of said main burners and a main swirler arranged around said main fuel nozzle of each of said main burners;

wherein said plurality of main burners comprises a first group of main burners, each of said first group of main burners including a first type of main fuel nozzle having a quantity of fuel injection ports arranged in two arrays on a circumference of each of said first type of main fuel nozzle, a first array of said two arrays of fuel injection ports including fuel injection ports arranged in a transverse sectional plane with respect to a central axis of said first type of main fuel nozzle at a downstream end of said first type of main fuel nozzle, and a second array of said two arrays of fuel injection ports including fuel injection ports arranged in a transverse sectional plane with respect to said central axis of said first type of main fuel nozzle at a position upstream of said first array of fuel injection ports;

wherein said plurality of main burners comprises a second group of main burners, each of said second group of main burners including a second type of main fuel nozzle having a quantity of fuel injection ports, said quantity of fuel injection ports of each of said second type of main fuel nozzle being a different quantity than said quantity of fuel injection ports of each of said first type of main fuel nozzle; and wherein said first group of main burners and said second group of main burners are alternately arranged around said periphery of said pilot burner.

2. The apparatus of claim 1, wherein said quantity of fuel injection ports of each of said second type of main fuel nozzle are arranged in a single group on a circumference of each of said second type of main fuel nozzle in a transverse sectional plane with respect to said central axis of said second type of main fuel nozzle.

3. The apparatus of claim 1, wherein said plurality of main burners comprises a third group of main burners, each of said third group of main burners including a swirler having swirler vanes set at a first fitting angle relative to said central axis of said main fuel nozzle;

wherein said plurality of main burners comprises a fourth group of main burners, each of said fourth group of main burners including a swirler having swirler vanes set at a second fitting angle relative to said central axis of said main fuel nozzle, said second fitting angle being different than said first fitting angle; and wherein said main burners are arranged around said periphery of said pilot burner such that one of said third group of main burners does not adjoin one of said fourth group of main burners.

4. The apparatus of claim 3, wherein at least a portion of said first group of main burners comprises at least a portion of said third group of main burners, and wherein at least a portion of said second group of main burners comprises at least a portion of said fourth group of main burners.

5. The apparatus of claim 3, wherein at least a portion of said first group of main burners comprises at least a portion of said fourth group of main burners, and wherein at least a portion of said second group of main burners comprises at least a portion of said third group of main burners.

6. The apparatus of claim 1, wherein said fuel injection ports of said first array are evenly spaced around a circumference of each of said first type of main fuel nozzle in a transverse sectional plane, and said fuel injection ports of said second array are evenly spaced around a circumference of each of said first type of main fuel nozzle in a transverse sectional plane.

7. The apparatus of claim 6, wherein said first array of fuel injection ports is rotated clockwise in a transverse-sectional direction of said main fuel nozzle so as to be offset with respect to said second array of fuel injection ports.

* * * * *